United States Patent [19]

Theurer

[11] Patent Number: 4,646,645

[45] **Date of Patent: * Mar. 3, 1987**

[54] MOBILE TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 608,999

[22] Filed: May 10, 1984

Related U.S. Application Data

[62] Division of Ser. No. 498,261, May 26, 1983, Pat. No. 4,596,193.

[30] Foreign Application Priority Data

Sep. 9, 1982 [AT] Austria ..... 3386/82

[51] Int. Cl.[4] ..... E01B 27/17

[52] U.S. Cl. ..... 104/7.2; 104/12

[58] Field of Search ..... 104/2, 7 R, 7 B, 12; 105/3, 4 R

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,595,170 | 7/1971 | Plasser et al. | 104/12 |
| 3,687,081 | 8/1972 | Plasser et al. | 104/12 |
| 3,690,262 | 9/1972 | Plasser et al. | 104/7 R |
| 3,744,428 | 7/1973 | Plasser et al. | 104/12 |
| 4,046,078 | 9/1977 | Theurer | 104/12 X |
| 4,165,694 | 8/1979 | Theurer | 104/12 X |
| 4,323,013 | 4/1982 | Theurer | 104/7 B |
| 4,356,771 | 11/1982 | Theurer | 104/7 B |
| 4,457,234 | 7/1984 | Theurer et al. | 104/12 X |

FOREIGN PATENT DOCUMENTS 1267322 3/1972 United Kingdom .

*Primary Examiner*—Randolph A. Reese
*Attorney, Agent, or Firm*—Kurt Kelman

[57] ABSTRACT

A mobile track leveling, lining and tamping machine has a main frame supported on undercarriages for mobility on the track in an operating direction, a drive for propelling the main frame in the operating direction, a carrier frame trailing the main frame in the operating direction, a single support and guide carriage supporting and guiding the carrier frame at a rear end thereof in the operating direction and spaced from one of the undercarriages of the main frame in the direction of the track, a tamping unit mounted on the carrier frame between the one undercarriage and the support and guide carriage, the tamping unit immediately preceding the support and guide carriage in the operating direction, a track leveling and lining unit preceding the tamping unit in the operating direction, a pivotal connection pivotally supporting a front end of the carrier frame on the main frame, and an adjustment drive at the pivotal connection for adjusting the position of the carrier frame in relation to the main frame in the operating direction.

3 Claims, 2 Drawing Figures

MOBILE TRACK LEVELING, LINING AND TAMPING MACHINE

Figure 1:
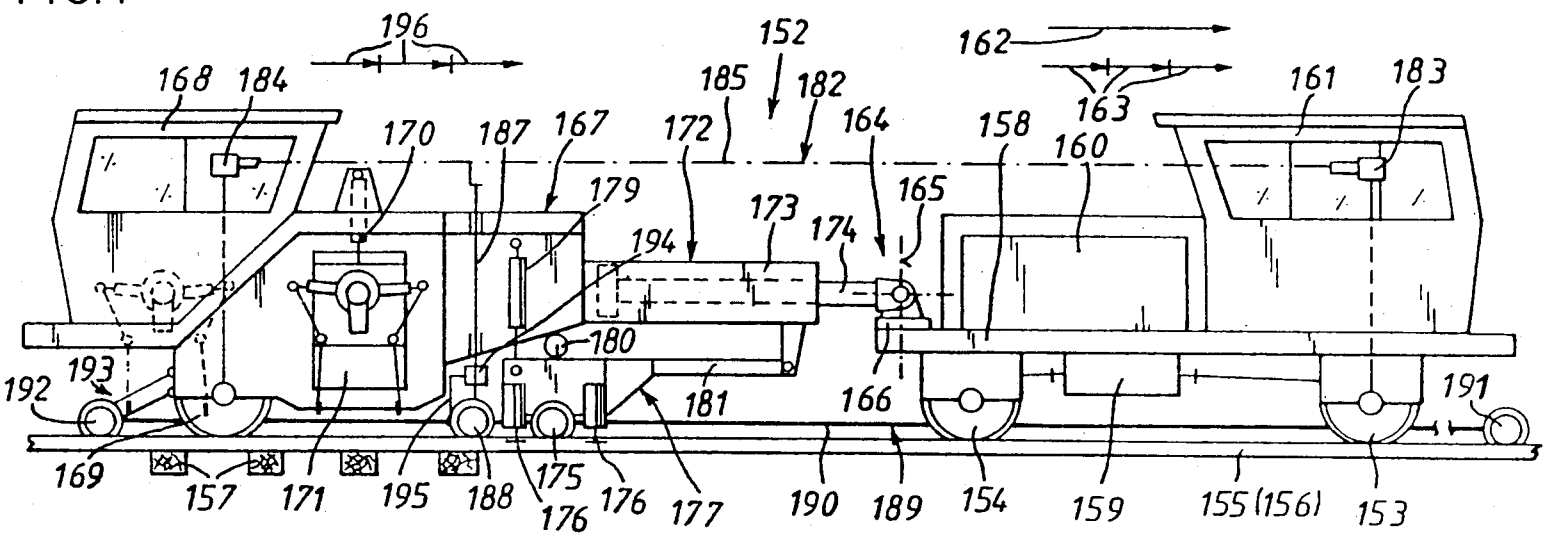

This is a division of my copending application Ser. No. 498,261, filed May 26, 1983, now U.S. Pat. No. 4,596,193.

The present invention relates to a mobile track leveling, lining and tamping machine comprising a main frame supported on undercarriages and a carrier frame pivotally connected thereto, the carrier frame mounting a tamping unit between two undercarriages spaced apart in the direction of the track and the undercarriages supporting the main and carrier frames for mobility on the track in an operating direction. The track consists of two rails fastened to successive ties resting on ballast.

U.S. Pat. No. 3,494,297, dated Feb. 10, 1970, discloses mobile track tamping machines capable of simultaneously tamping a plurality of ties with a succession of ballast tamping units associated with each track rail. One of the embodiments of the disclosed machines has the above-described structure and the succession of tamping units is mounted on the second frame which has two sets of wheels spaced apart in the direction of the track for guiding the second frame therealong. Two jacks link the second frame to the first frame for vertically adjusting the second frame in relation to the first frame and the second frame is equipped with rail clamps in the region of the two sets of wheels for lifting the track when the second frame is raised. A track lining tool unit is mounted at the rear of the machine, in the operating direction. This arrangement enables the track to be leveled in two successive stages.

U.S. Pat. No. 3,690,262, dated Sept. 12, 1972, discloses a mobile track tamping, leveling and lining machine with three undercarriages spaced apart in the direction of the track. A ballast tamping unit as well as a track leveling and lining tool unit are arranged between the center and rear undercarriages, in the operating direction, while the front undercarriage is adjustable in the track direction or the direction of elongation of the machine and may be vertically adjusted. In this manner, the machine frame may be selectively supported on the center or front undercarriage and the distance thereof from the track leveling and lining tool unit may be so adjusted in relation to the required lifting stroke for leveling the track that the track rails are only elastically deformed during the leveling operation and are not subjected to undue stresses which may cause permanent deformations in the rails. When the machine frame is supported on the front undercarriage, relatively large lifting strokes are made possible. On the other hand, the adjustability of the front undercarriage position makes it possible to maintain the proper wheel base when the machine is moved between working sites.

U.S. Pat. No. 3,687,081, dated Aug. 29, 1972, discloses a mobile track tamping, leveling and lining machine which advances non-stop and whose operating units are supported on elongated guides on the main frame of the machine. Suitable controls enable the units to be driven step-wise along the guides from tamping point to tamping point as the machine advances continuously. Similar arrangements for the combined use of track working cars some of which advance continuously while others advance step-by-step are shown in British Pat. No. 1,267,322, published Mar. 15, 1972.

U.S. Pat. No. 3,469,534, dated Sept. 30, 1969, discloses a mobile track tamping, leveling and lining machine. In certain embodiments of this machine, the machine frame has a cantilevered portion projecting beyond the front undercarriage and being pivoted to the frame, the cantilevered front portion of the frame carrying ballast tamping units and a track lifting tool unit. The machine frame is supported on the track on the front and a rear undercarriage, and a track lining tool unit is mounted thereon between the undercarriages.

U.S. Pat. No. 4,356,771, dated Nov. 2, 1982, discloses a self-propelled track working machine comprising two vehicles moved along the track by respective drives. Track working tools, including tamping tools, as well as a television camera for viewing selected tools are mounted on one of the vehicles between two undercarriages supporting the one vehicle for mobility on the track. A central monitoring and control panel is mounted on the other vehicle out of sight of the selected tools and the television camera is connected to a television screen on the panel to enable an operator there to view the operation of the tools. The drive for the one vehicle moves the one vehicle intermittently from tie to tie while the drive for the other vehicle moves the other vehicle non-stop ahead of the one vehicle, a control between the vehicles keeping the other vehicle at a constant speed and a desired distance from the one vehicle.

It is the primary object of this invention to provide a mobile track leveling, lining and tamping machine of the first-indicated type but which is simpler with respect to the ballast tamping unit arrangement and enables the tamping tools associated with each rail to conform more closely to the level and the lateral alignment of the track wherealong it advances while enabling the machine to operate in a variety of ways.

The above and other objects are accomplished according to the invention with a mobile track leveling, lining and tamping machine which comprises a main frame supported on undercarriages for mobility on the track in an operating direction, a drive for propelling the main frame in the operating direction, a carrier frame trailing the main frame in the operating direction, a single support and guide carriage supporting and guiding the carrier frame at a rear end thereof in the operating direction and spaced from one of the undercarriages of the main frame in the direction of the track, a tamping unit mounted on the carrier frame between the one undercarriage and the support and guide carriage, the tamping unit immediately preceding the support and guide carriage in the operating direction, a track leveling and lining means preceding the tamping unit in the operating direction, a pivotal connection pivotally supporting a front end of the carrier frame on the main frame, and an adjustment drive at the pivotal connection for adjusting the position of the carrier frame in relation to the main frame in the operating direction.

The adjustment drive between the main and carrier frames may be selectively operated to enable the machine to be advanced continuously or in three other desired modes at varying wheelbases. At the same time, the carrier frame serves to mount all the track correction tools to form a unitary operating structure while the main frame carries the power plant, drive and control means. The sole support and guide carriage for the carrier frame may be sufficiently spaced in the direction of the track from the undercarriage of the main frame immediately preceding the support and guide carriage in the operating direction to enable the track leveling and lining means arranged therebetween to effect substantial track correction displacement movements in a lateral and/or vertical direction for lining and/or leveling without subjecting the rails to undue stresses, as is known from bridge-type track leveling, lining and tamping machines where all the working tools are mounted on the main frame between the undercarriages.

In addition, the ballast tamping units associated with each rail are independently and precisely guided so that they must follow the vertical and lateral path of the track whereby an exact centering of the tamping tools on the gage and field sides of each rail with respect to the center line of the track is assured when the tools are immersed in the ballast for tamping ballast under the ties. Since each tamping unit conventionally comprises four to sixteen tamping tools which must be properly aligned with respect to each track rail, this automatic centering of the ballast tamping units is of great importance as far as an efficient and trouble-free tamping operation is concerned. This advantage is obtained by the freely movable steering axle of the carrier frame for the ballast tamping unit, which is the sole support and guide for the carrier frame on the track and whose free movement enables the carrier frame to follow the track since the other end of the carrier frame is merely pivotally connected to the main machine frame without any adjustment drive or position control. The pivotal connection between the carrier and main frames serves as the fulcrum for the free movement of the steering axle about this center of the axle's pivoting movement and this arrangement has considerable advantages over a ballast tamping unit carrier frame which runs on the track independently of the main frame on rear and front undercarriages. Thus, the carrier frame necessarily follows the movement of the main frame to which it is pivotally connected at its rear end while the distance between the rear end and the steering axle at its front end, i.e. the pivoting radius of the steering axle about the fulcrum, which is decisive for the positioning of the carrier frame in track curves, may be freely selected, this distance being simply a function of the length of the carrier frame. At the same time, the support of the carrier frame loaded by the heavy weight of the tamping units on the track provides an advantage over conventional tampers wherein the weight is carried by the main machine frame because it substantially reduces the stresses to which the main frame is subjected through the connecting joint between the main and carrier frames, particularly if the distance between the pivotal connection of the carrier frame to the main frame and the steering axle supporting the carrier frame on the track is selected relatively large within the structural limits of the machine. Finally, the distribution of the total weight of the machine over the two main undercarriages and the other undercarriage, which is the steering axle and which may be a single-axle undercarriage or a swivel truck, reduces the load on the individual undercarriages, which is of particular importance when the machine is used on branch tracks normally capable only of receiving limited loads.

Figure 2:
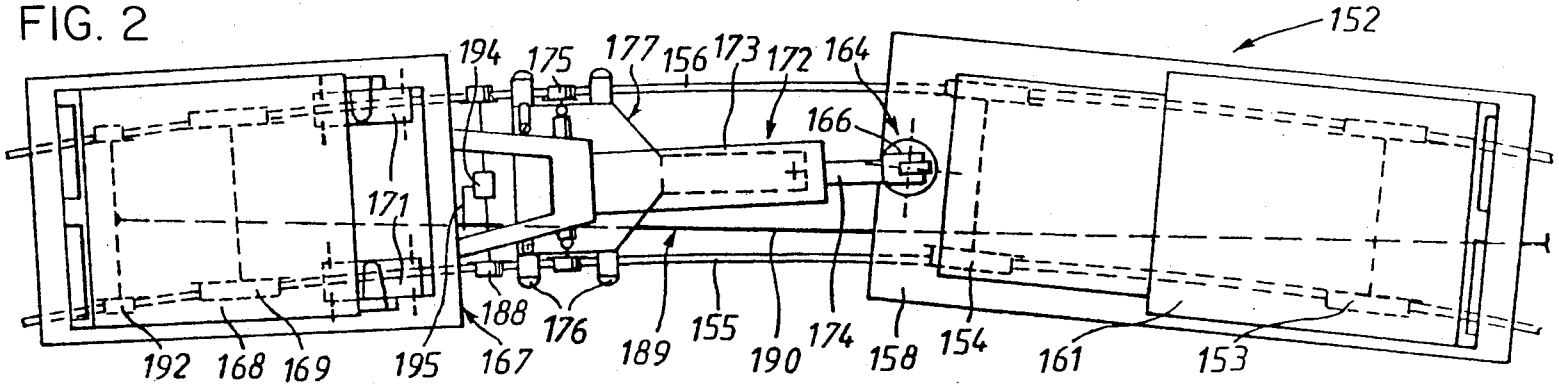

The above and other objects, advantages and features of the present invention will become more apparent from the following detailed description of a now preferred embodiment, taken in conjunction with the accompanying drawing wherein FIG. 1 is a side elevational view of the mobile track leveling, lining and tamping machine according to this invention; and FIG. 2 is a top view thereof.

FIGS. 1 and 2 show track leveling, lining and tamping machine 152 comprising two pivotally connected frames 158 and 167. Main frame 158 is supported on the track consisting of rails 155, 156 fastened to ties 157 on undercarriages 153, 154 for mobility in an operating direction indicated by arrow 162. The main frame has drive 159 transmitting power to the wheels of both undercarriages and is a heavy machine frame carrying power plant 160 and operator's cab 161. Arrows 163 symbolize an intermittent advance of main frame 158 in the operating direction. Carrier frame 167 having a rear portion and forwardly projecting centered pole portion 172 is pivotally connected to the main frame, a front end of carrier frame pole portion 172 being supported on the main frame by a pivotal connection constituted by bearing 164 consisting of coupling 166 pivotal about vertical axis 165. In this embodiment, the carrier frame is relatively heavy, too, and carries operator's cab 168. A respective ballast tamping unit 171 associated with each track rail is mounted on carrier frame 167 and is vertically adjustable thereon by drive 170. The rear portion of the carrier frame is supported on the track by a single-axle undercarriage 169 with a set of wheels constituting the sole support and guide carriage of the carrier frame on the track and, since the carrier frame is pivoted to the main frame at an opposite end, carriage 169 is a freely movable steering axle for the carrier frame, the ballast tamping unit being mounted between undercarriage 154 and carriage 169 supporting the main and carrier frames on the track for mobility in the operating direction. Adjustment drive 173 at the pivotal connection between the frames enables the distance therebetween to be adjusted in the operating direction. The drive is arranged to provide an adjustment path for the position of the carrier frame in relation to the main frame of a length at least twice the average distance between the ties for enabling the main frame to advance continuously and non-stop along the track while the position of the carrier frame and the ballast tamping unit thereon is adjusted step-wise during the continuous and non-stop advance as the machine moves from tamping stage to tamping stage. The adjustment drive is constituted by a hydraulic cylinder-and-piston device, pole portion 172 of carrier frame 167 forming the cylinder of the device and piston rod 174 of the adjusting drive being linked to coupling 165 for pivoting about a horizontally extending, transverse axis perpendicular to axis 165. A valve arrangement controls the piston movement of the device synchronously with, but in the opposite direction of, the continuous and non-stop advance of the first frame. In this manner, a universal joint is formed between the main and carrier frames.

Track leveling and lining tool unit 177 precedes tamping unit 171 in the operating direction and comprises, in the operating direction, a rear portion adjacent the rear portion of the second frame and a centered pole portion extending forwardly therefrom, flanged lining rollers 175 supporting the rear portion of the track leveling and lining tool unit on the track rails, two pairs of lifting rollers 176 running on the track rails, and lining and lifting drives 179 and 180 connecting the rear portion of the track leveling and lining tool unit to the carrier frame. Centered pole portion 181 of the track leveling and lining tool unit has a front end linked to the carrier frame and extends in the operating direction.

Machine 152 is equipped with optical leveling reference system 182 with infra-red, laser or other beams transmitted from senders 183 to receivers 184 constituting two leveling reference lines above each rail, the senders being mounted on front undercarriage 153 in a track section to be corrected and the receivers being supported on undercarriage 169 in a previously corrected track section. A shadow board supported by rod 187 on track sensing element 188 cooperates with each reference beam for controlling the track level. Furthermore, the machine is also equipped with lining reference system 189 comprising reference rod 190 whose respective ends are anchored to track sensing elements 191, 192 and which extends substantially centrally between the track rails. Parallelogram guide 193 attaches rear track sensing element 192 to carrier frame 167 so that it moves with the carrier frame. Rotary potentiometer 194 is mounted on track sensing element 188 and cooperates with reference rod 187 to measure the actual line of the track and, in a known manner, a forked arm of the potentiometer engages rod 190 for generating a lining control signal.

FIG. 2 clearly illustrates the automatic guidance of carrier frame 167 and the operating units thereon by steering axle 169 to follow the track independently of the movement of the main frame. Therefore, in a curve, the tamping tools of unit 171 and the leveling and lining tools of unit 177 will always be properly centered over the rails in a direction transverse to the track.

As is evident from the above description and the drawing, track leveling, lining and tamping machine 152 may be operated in four modes. In a first mode, drive 159 propels the main frame continuously in the operating direction indicated by arrow 162 and adjustment drive 173 is so synchronized with drive 159 that it continuously adjusts the distance between continuously advancing main frame 158 and carrier frame 167 so that the latter advances intermittently from tie to tie, as indicated by arrows 196 to enable successive ties 157 to be tamped. Since the view from cab 161 on the main frame to tamping tool units 171 is substantially unimpeded, the operator in this cab has the tamping tools in sight and may monitor the track correction operation. This operator is, therefore, not subject to the vibrations and is removed from the noise generated by the tamping tools mounted on the carrier frame.

In addition, when adjustment drive 173 is blocked to keep a constant distance between the main and carrier frames, i. e. a pre-set wheel base, machine 152 may be operated in three additional modes in all of which the main frame advances intermittently, as indicated by arrows 163, in unison with the trailing carrier frame. In one of these modes, the machine operates like a conventional track leveling, lining and tamping machine with a single elongated machine frame carrying operator's cabs at its front and rear ends, the operators in cabs 161 and 168 being in a position to monitor the operation. In another one of these modes, drive 173 is extended so that the distance between undercarriage 154 of the main carriage and carriage 169 of the carrier frame is increased, thus enabling large track correction strokes to be effected without undue stress on the track rails. In this mode of operation, the operator in cab 168 will primarily monitor the operation. Finally, adjustment drive 173 may be retracted to move support and guide carriage 169 of the carrier frame closer to preceding undercariage 154 of the main carriage. Depending on the operating direction, this enables the operator in either cab to monitor the operation or a single operator to be used in either cabin.

What is claimed is:

1. A mobile track leveling, lining and tamping machine which comprises a main frame suppported on undercarriages for mobility on the track in an operating direction, a drive for propelling the main frame in the operating direction, a carrier frame trailing the main frame in the operating direction, the carrier frame having, in the operating direction, a rear portion and a centered pole portion extending forwardly therefrom, a single support and guide carriage constituting a freely movable steering axle comprising a set of flanged wheels running on the track rails and supporting and guiding the rear frame portion thereon, the support and guide carriage being spaced from one of the undercarriages of the main frame in the direction of the track, a tamping unit mounted on the rear frame portion between the one undercarriage and the support and guide carriage, the tamping unit immediately preceding the support and guide carriage in the operating direction, a track leveling and lining means on the carrier frame and preceding the tamping unit in the operating direction, the centered pole portion being constituted by an elongated boom-shaped carrier extending in the operating direction and having a front end linked to the main frame to form a pivotal connection pivotally supporting the front end on the main frame, and an adjustment drive housed in the boom-shaped carrier for adjusting the position of the carrier frame in relation to the main frame in the operating direction, the adjustment drive being arranged to provide an adjustment path for the position of the carrier frame in relation to the main frame of a length at least twice the average distance between the ties for enabling the main frame to advance continuously and non-stop along the track while the position of the carrier frame and the tamping unit thereon is adjusted step-wise during the continuous and non-stop advance as the machine moves from tamping stage to tamping stage.

2. The track leveling, lining and tamping machine of claim 1, wherein the adjustment drive is a double-acting hydraulic cylinder-and-piston device having a piston movement controlled synchronously with, but in the opposite direction of, the continuous and non-stop advance of the main frame, and blockable to keep a constant distance between the main and carrier frames.

3. The track leveling, lining and tamping machine of claim 1, wherein the track leveling and lining means comprises a track lifting and lining tool unit including, in the operating direction, a rear portion adjacent the rear portion of the carrier frame and a centered pole portion extending forwardly therefrom, flanged lining rollers supporting the rear portion of the track leveling and lining tool unit on the track rails, drive means for the leveling and lining tools connecting the rear portion of the track leveling and lining tool unit to the carrier frame, and the centered pole portion of the track leveling and lining tool unit having a front end linked to the carrier frame and extending in the operating direction.

* * * * *